US005742256A

United States Patent [19]

Wakabayashi

[11] Patent Number: 5,742,256

[45] Date of Patent: Apr. 21, 1998

[54] WRISTBAND HAVING EMBEDDED ELECTRICALLY CONDUCTIVE MEMBERS FOR A WRIST-MOUNTABLE TYPE ELECTRONIC DEVICE

[75] Inventor: Teruhiko Wakabayashi, Suwa, Japan

[73] Assignee: Seiko Epson Corporation, Tokyo, Japan

[21] Appl. No.: 236,290

[22] Filed: Apr. 29, 1994

[30] Foreign Application Priority Data

May 7, 1993 [JP] Japan ..... 5-106935
Jun. 3, 1993 [JP] Japan ..... 5-133632

[51] Int. Cl.[6] ..... H01Q 1/12

[52] U.S. Cl. ..... 343/718; 343/870; 343/741; 224/178

[58] Field of Search ..... 343/718, 741, 343/743, 866, 868, 870, 748; 224/178; H01Q 1/12

[56] References Cited

U.S. PATENT DOCUMENTS 5,128,686 7/1992 Tan et al. ..... 343/718
5,135,694 8/1992 Akahane et al. ..... 264/138
5,152,693 10/1992 Matsui et al. ..... 439/37
5,168,281 12/1992 Tokunaga ..... 343/718
5,179,733 1/1993 Matsui ..... 455/344

*Primary Examiner*—Hoanganh Le
*Attorney, Agent, or Firm*—Mark P. Watson

[57] ABSTRACT

A wristband for a wrist-mountable type electronic device comprises two wristband segments each including an outer layer member, an inner layer member and an antenna strip made of an electrically conductive member sandwiched between these members. The outer layer member is made of an ornamental material such as leather, while the inner layer member is made of urethane. The inner layer member includes extended portions which extend beyond the edges of the electrically conductive member to cover laterally the side edges of the outer layer member. The inner layer member also has a recess formed at its outer surface continuously extending along the longitudinal direction of the wristband. According to the present invention, the appearance of the wristband is improved, and the feel of the wristband is enhanced when it is mounted. Further, durability of the wristband is also improved.

27 Claims, 10 Drawing Sheets

WRISTBAND HAVING EMBEDDED ELECTRICALLY CONDUCTIVE MEMBERS FOR A WRIST-MOUNTABLE TYPE ELECTRONIC DEVICE

BACKGROUND OF THE INVENTION

The present invention relates generally to wrist-mountable type electronic devices such as pagers, radio receivers or the like. More specifically, the present invention pertains to a wristband of such an electronic device having embedded electrically conductive members.

There are a variety of wrist-mountable type electronic devices, examples of which are disclosed in U.S. Pat. Nos. 5,179,733, 5,135,694, 5,152,693, 5,168,281 and the like. Among these patents, U.S. Pat. No. 5,179,733 discloses a typical wrist watch type radio set referred to as a pager which has a main body and a pair of wristbands connected to both sides of the main body. The wristbands are molded parts, for example, of silicone resin, and have antenna strips made of stainless steel which are embedded integrally in the respective molded parts. The wristbands are usually manufactured by injection molding. In other words, the outer or inner layer of the wristband is injection molded in a manner that the antenna strip is placed in a mold, and thereafter the other layer of the wristband is injection molded. The resulting wristband is constituted such that the antenna strip is placed between the outer and inner silicone resin layers.

Each of the antenna strip is connected at its proximal end with a thick metal plate referred to as an end piece, through which the wristband is fixed to the side of the main body by a screw. Further, the end piece is connected with a connecting pin which is electrically connected to the electronic circuitry in the main body. The connecting pin is usually welded to the end piece. The connecting pins of the respective antenna strips are placed penetrating through holes formed at the both sides of the casing of the main body. The connecting pins are covered by insulating materials or insulating rubber bushings in order to electrically insulate from the casing of the main body. In addition, a seal ring is inserted between the connecting pin and the hole in order to provide water resistance. The structure is disclosed, for example, in U.S. Pat. No. 5,168,281.

On the other hand, one of the wristbands is provided at its free end with a first metal clasp piece electrically connected to the antenna strip in the wristband, while the other wristband is also provided at its free end with a second metal clasp piece which is releasably fixed to the first metal clasp piece. The second metal clasp piece is slidably mounted on the wristband and has a projection for electrically connection with the antenna piece embedded in the wristband. By fastening the first and second clasp pieces, the antenna strips of the respective wristbands are electrically connected to form a loop antenna assembly for the radio set.

However, the conventional wristband structure has problems in terms of appearance, strength and feel when mounted as will be described below. First, the wristband made of silicone resin has a low viscosity because it has a thin metal strip embedded therein, as the antenna. The wristband of silicone resin, however, lacks good quality of appearance in terms of commercial aspect.

Second, the conventional wristband, especially that made of silicone resin lacks elastically shearing strength, so that shearing is likely to occur at the periphery of the antenna strip. There is a possibility that the edge of the antenna strip exposed through the sheared portion of the wristband can hurt the user's wrist. Further, since the conventional wristband has low wear resistance, fine patterns formed on the outer or inner surface of the wristband is likely to wear out after a long period of time. Also, the wristband of silicone resin is likely to become clammy with sweat. Thus, in the conventional wristband, its appearance and feel to the user's wrist are readily degraded.

Third, the wristband is constituted such that the antenna strip is covered at its upper and lower surfaces with silicone resin layers, these layers being injection molded separately. Thus, the parting line of the upper and lower layers is positioned on the same plane on which the antenna strip is placed. Since the portion of the wristband where the parting line is positioned has inferior adhesive strength, tears are likely to occur in this portion.

Fourth, the antenna strip inserted between the upper and lower resin layers of the wristband has a plurality of holes formed therein as shown in U.S. Pat. No. 5,179,733 so that the upper and lower resin layers are securely fixed to each other through these holes. In the antenna strip having the holes, however, the periphery of each of the holes suffers from stress concentration due to bending stress applied to the wristband during use. This causes the antenna strip to bend, and thus must be avoided.

Fifth, conventionally, the antenna strip is cut from a rolled sheet along a direction perpendicular to the rolled direction in order to increase yield. Thus, the antenna strip embedded in the wristband has the rolled direction extending along its width direction, and therefore it is likely to bend along the width direction when bending stress is applied repeatedly during use.

Sixth, at the inner surface of the conventional wristband, a plurality of exposed portions of the antenna strip are provided so that the metal clasp piece can be slid to predetermined positions along the longitudinal direction of the wristband, whereby the length of the wristbands can be adjusted to the size of the user's wrist while maintaining electrical contact to the antenna strip. However, since the exposed portions of the antenna strip are provided at predetermined positions along the wristband, the adjustment of the length of the wristbands is limited by the positions of the exposed portions of the antenna strip. Thus, it is not always expected to be able to adjust the length of the wristband to an appropriate size for the user's wrist. Further, when the wristband is mounted around the user's wrist, sealed small spaces between the respective exposed portions and the user's wrist are formed, in which sweat or dust is likely to deposit to cause the electrical conductivity to deteriorate, and to cause the feel of the wristband to worsen when it's mounted.

Moreover, in the conventional wrist-mountable type electronic devices, there are problems in the connecting structure of the wristband to the main body. First, in order to obtain a sufficient strength of the connecting structure of the wristband to the main body, the end piece made of thick metal plate is attached to the end of the antenna strip as mentioned above. The provision of the metal plate may cause the floating capacitance of the antenna strip to change. Further, since the metal end piece must be electrically insulated from the casing of the main body, an insulating plate or the like must be inserted between the casing and the metal end piece, which causes the connecting structure of the wristband to the main body to be complicated and causes the manufacturing cost to increase. In addition, since the screws for fastening the wristband to the main body must be electrically insulated from the metal end piece, insulating members such as tubular rubber bushings are required to be placed between them, which causes the connecting structure of the wristband to the main body to be even more complicated.

Next, the antenna strip embedded in the wristband is electrically connected to the electronic circuitry housed in the main body via the connecting pin penetrating through the hole on the casing of the main body. Thus, it is necessary to secure a water-sealing structure of the hole communicating between the inner side of the main body and the outer side. However, where a seal ring is used, a water-sealing structure cannot always be expected due to the errors of the position of the hole, connecting position of the pin and the like. Therefore, electrical insulation between the pin and the hole cannot be secured.

Further, in the conventional wrist-mountable type electronic devices, the wristband is secured to the main body case in such a manner that the proximal end of the wristband is sandwiched between the main body case and the case back, and thereafter it is fastened by screws to the main body. The securing of the wristband to the main body is not easy.

Accordingly, an object of the present invention is to provide a wristband for a wrist-mountable type electronic device which has an improved appearance.

Another object of the present invention is to provide a wristband for a wrist-mountable type electronic device which has a strong durability.

Another object of the present invention is to provide a wristband for a wrist-mountable type electronic device which has a high elastic sheafing strength.

Still another object of the present invention is to provide a wristband for a wrist-mountable type electronic device which provides an improved feel characteristic when it is mounted around the user's wrist.

Moreover, another object of the present invention is to provide a wrist-mountable type electronic device which has a simplified connecting structure between a wristband and a main body of the electronic device.

Still another object of the present invention is to provide a wrist-mountable type electronic device which has an improved waterproof structure for a connecting portion between a wristband and a main body of the electronic device.

Still another object of the present invention is to provide a wrist-mountable type electronic device which has an improved insulating structure for a connecting portion between a wristband and a main body of the electronic device.

SUMMARY OF THE INVENTION

In order to achieve the above and other objects, according to one embodiment of the present invention, there is provided a wristband having electrically conductive members embedded therein for a wrist-mountable type electronic device. The wristband comprises two segments each having an outer layer member and an inner layer member sandwiching an electrically conductive member. The outer layer member and inner layer member are made of different kinds of materials. An ornamental material such as leather or the like is preferable for the outer layer member, whereby a high quality of appearance compared to that of wristbands of wrist watches can be achieved.

The inner layer member of the present invention is made of an insulating material, preferably of urethane. Since urethane is superior to silicone resin in terms of elastic shearing strength and wear resistance, it is less likely that the wristband made of urethane is sheared or worn out after a long period of use in comparison with the conventional wristband made of silicone resin.

According to one aspect of the invention, one of the outer layer member and the inner layer member, includes extended portions which cover the outer periphery side portions of the other member. This assures a sufficient fixing strength between these members of the wristband. In addition, where the outer layer member is made of leather and the inner layer member is made of urethane, the outer periphery side portions of the leather which exhibit fibrous surfaces can be covered and hid by the inner layer member of urethane, thus avoiding degradation of the appearance of the wristband.

According to another aspect of the invention, fixing the electrically conductive member on at least one of the outer layer member and the inner layer member is carried out by using primers or adhesives to assure the integrity of these members. According to the present invention, since it is not necessary to form a plurality of holes in the electrically conductive member for increasing the fixing strength of the members, the electrically conductive member can be prevented from being broken by stress concentration appeared around the holes of the electrically conductive member when the wristband is repeatedly applied with bending stress during use.

According to still another aspect of the invention, the inner layer member of the wristband has a thin portion on its surface. With this structure, the wristband is provided with a sufficient flexibility even though it has the embedded electrically conductive member with high rigidity. It is preferable that the thin portion of the inner layer member is in the form of a groove extending along the longitudinal direction of the wristband. With this arrangement, when it is mounted around the user's wrist, deposition of dust or the like in the thin portion of the wristband can be prevented. Therefore, when it is mounted, the feel of the wristband can be improved. In the present invention, an end piece on the end of the electrically conductive member embedded in the wristband is made of an insulating resin material different from that for the inner layer member.

According to the present invention, the electrically conductive member is obtained by cutting out a rolled sheet in such a manner that the rolled direction of the sheet is not aligned to the width direction of the wristband. Therefore, the durability of the electrically conductive member can be enhanced.

The wristband of the present invention can be used for the wrist watch-type radio set having a loop antenna. The loop antenna can be formed by electrically connecting a pair of segments of the wristband with a metal clasp. In this case, it is preferable that one of the wristband segments includes an exposed portion of the electrically conductive member on its inner surface extending along the longitudinal direction. The clasp can be slid to a desired position along the longitudinal direction of the wristband while maintaining electrical contact with the electrically conductive member in the wristband, so that the length of the wristbands can be freely adjusted to the size of the user's wrist. In addition, when it is mounted around the user's wrist, sweat or dust does not deposit on the thin portion of the wristband, thus preventing deterioration of the conductivity between the electrically conductive member and the clasp.

According to another embodiment of the present invention, there is provided a wrist-mountable type electronic device comprising a main body including electronic circuitry, a wristband having two segments each including an electrically conductive member and an electrical connecting pin fixed on a proximal end of the electrically conductive member and penetrating through a hole in the main body to electrically connect to the electronic circuitry in the main body. The proximal end portion of the electrically conductive member to which the connecting pin is fixed is integrally covered by an end piece made of an insulating material having a high mechanical strength compared with the material for the wristband. According to the present invention, since the wristband is connected to the main body via the end pieces having high strength, the strength of the connecting portions of the wristband to the main body is comparable to that of a metal end piece. Further, since the end pieces are made of insulating material, insulation of the connecting portions of the wristband to the main body can be assured.

It is preferable that the proximal end portion of the electrically conductive member is a deformed portion such as a bent portion so as to assure the integrity of the electrically conductive member and the end piece. In order to further enhance the integrity of these members, it is preferable that the end piece is at least partially covered by the material forming the wristband.

According to the present invention, each wristband segment is provided at the proximal end with a projected portion including the end piece for inserting into the main body side. The connecting pin is placed so that it projects from the projected portion. The main body is provided with a groove into which the projected portion is insertable. The groove includes a hole through which the connecting pin is inserted. Further, temporary engagement portions are provided on the inserting projected portion and the groove. By providing the temporary engagement portions, when the wristband is to be connected to the main body, the wristband can be temporarily fixed to the main body by simply inserting the projected portion into the groove. Thus, the connection of the wristband to the main body can be carried out easily.

In one embodiment, there is provided a tubular elastic member made of insulating material between the connecting pin and the hole. The tubular elastic member has a flange at one end facing the wristband side. The flange has an outer diameter larger than the inner diameter of the hole. With this tubular elastic member the connecting pin is reliably insulated from the hole. In addition, a waterproof structure at the hole can be obtained by using the flange of the tubular elastic member. Accordingly, the electrical insulation and water sealing between the pin and the hole can be simultaneously obtained by using the tubular elastic member. In order to enhance the waterproof property, the thickness of the flange of the tubular elastic member is preset so that the flange can be elastically compressed by a certain amount in the thickness direction of the flange when the wristband is connected to the casing of the main body.

In addition, it is preferable that the root portion of the connecting pin include a circumferentially tapered outer portion capable of expanding the tubular elastic member in its radial direction when the connecting pin is inserted into the tubular elastic member. Since the circumferentially tapered outer portion of the connecting pin functions as a guide surfaces, the insertion can be carried out easily. At the same time, since the tubular elastic member is expanded in the radial direction by the circumferentially tapered outer portion when the pin is inserted, the waterproof property at the hole can be enhanced. Furthermore, when the wristband is disassembled from the main body, the tubular elastic member can easily be removed from the connecting pin because of the presence of the tapered outer portion.

In this embodiment, the projected portion of the wristband includes pin-inserting through-holes extending in the thickness direction of the main body. The casing of the main body includes pin-fitting holes at portions facing the through-holes. A pin with a flange is inserted into each of the pin-inserting through-holes and is fitted at its both ends into the fitting holes of the casing in a manner that the flange of the pin is sandwiched between the projected portion and the casing of the main body. Thus, the wristband can be positioned and fixed to the casing of the main body. Therefore, the connection of the wristband to the main body can be carried out easily. Further, the connecting structure of the wristband to the main body is simple.

In an alternative embodiment, instead of the pins, screws can be used to connect the wristband to the casing of the main body. In this case, the projected portion includes screw holes instead of pin-inserting holes, and the casing of the main body also includes screw holes instead of the pin-fitting holes. With this arrangement, the same effects and advantages as those obtained by using the pins can be obtained. Further, where the wristband is connected to the main body by screws independent of those fastening the casing and the case back, the wristband can be easily replaced by releasing only the screws for fastening the wristband to the main body.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
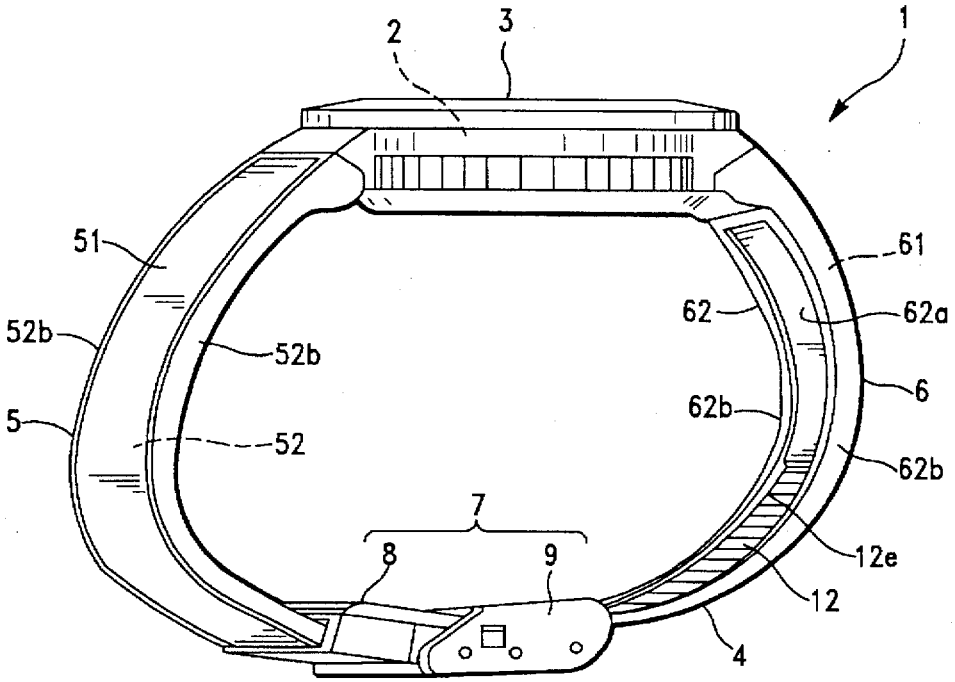
FIG. 1 is a perspective view of a wrist-mountable type electronic device having a wristband according to the present invention.
Figure 2:
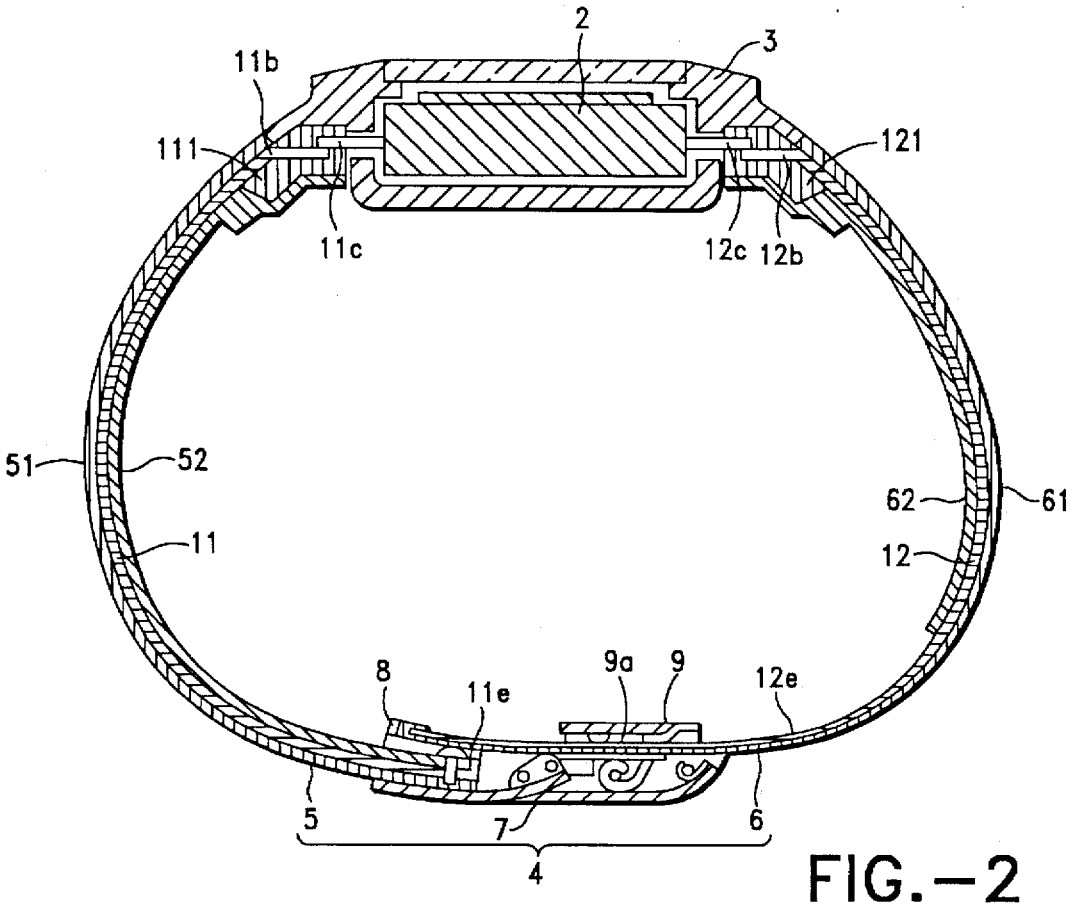
FIG. 2 is a cross-sectional view taken longitudinally of the wristband of FIG. 1.
Figure 3:
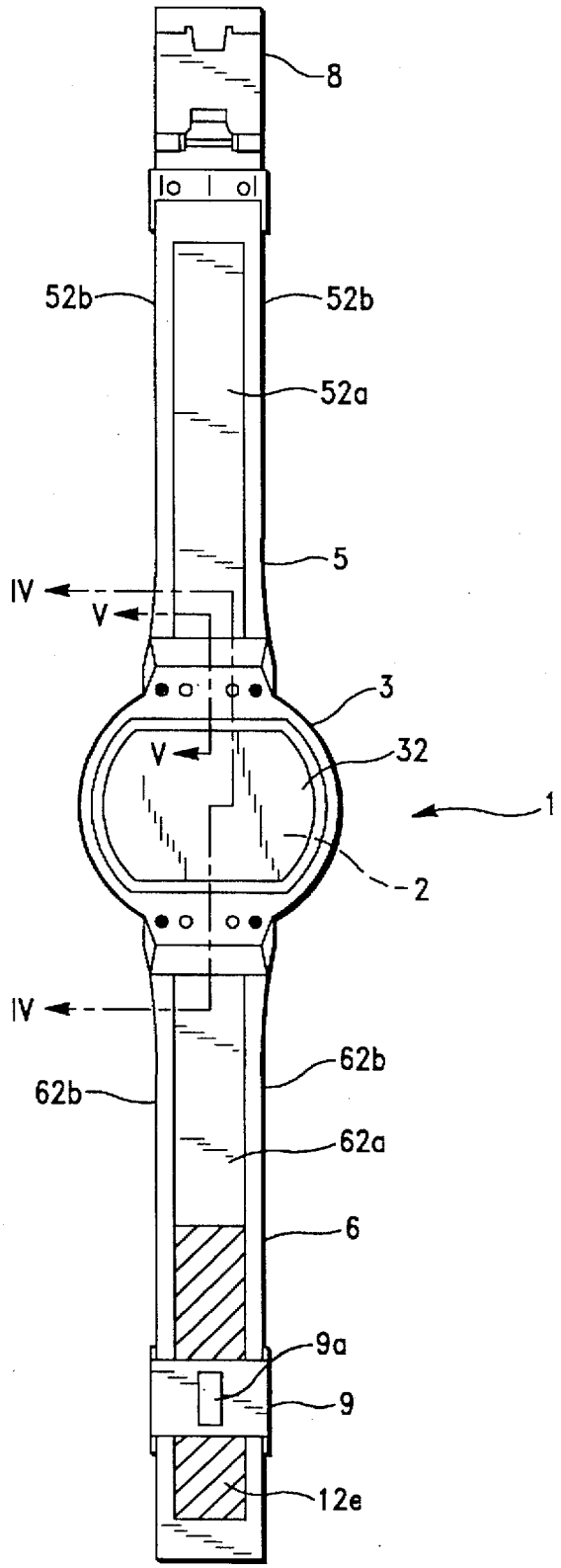
FIG. 3 is a rear-side plan view of the wrist-mounted type electronic device of FIG. 1.

FIGS. 1, 2 and 3 are a perspective view, a longitudinal sectional view and a rearside plan view of a wrist watch-type wireless set according to the present invention. As shown in these figures, wrist watch-type wireless set 1 basically comprises a wrist watch main body 3 in which a radio communicating unit 2 is housed, and a wristband 4 attached to main body 3. Radio communicating unit 2 is of the conventional type, and therefore the description is omitted.

Wristband 4 comprises a pair of wristband segments 5 and 6 attached to the both sides of the wrist watch main body 3 (corresponding to the directions of twelve and six o'clock sides of the wrist watch), and a metal clasp 7 for coupling the ends of wristband segments 5, 6 to each other. Metal clasp 7 includes a first portion 8 fixedly connected to the end of first wristband segment 5 and a second portion 9 slidably mounted on the end of second wristband segment 6, the first and second portions 8 and 9 being capable of releasably coupled to each other.

First wristband segment 5 has an outer layer member 51, an inner layer member 52 for contact with the user's wrist and a first electrically conductive antenna strip 11 of stainless steel enclosed between members 51 and 52. Likewise, second wristband segment 6 has an outer layer member 61, an inner layer member 62 and a second electrically conductive antenna strip 12. First and second antenna strips 11 and 12 are electrically coupled together by metal clasp 7 to form a loop antenna of wireless set 1.

Wristband Segment 5

The structure of the wristband segment 5 will be described in detail, in conjunction with FIGS. 6 and 8. Wristband segment 5 has an outer layer member 51 made of an ornamental material such as leather and an inner layer member 52 made of a molded part of urethane. Inner layer member 52 of urethane is formed with a recess 52*a* extending along the longitudinal direction of the wristband segment. With recess 52*a* being provided, wristband segment 5 is provided with sufficient flexibility even though it includes the rigid antenna strip of stainless steel. In addition, since recess 52*a* extends continuously along the longitudinal direction of the wristband segment, sealed small spaces will not be formed between the wristband segment and the user's wrist when it is mounted around the user's wrist. Hence, sweat or dust can be prevented from being gathered in the recess to degrade the feel of the wristband.

Figure 8:
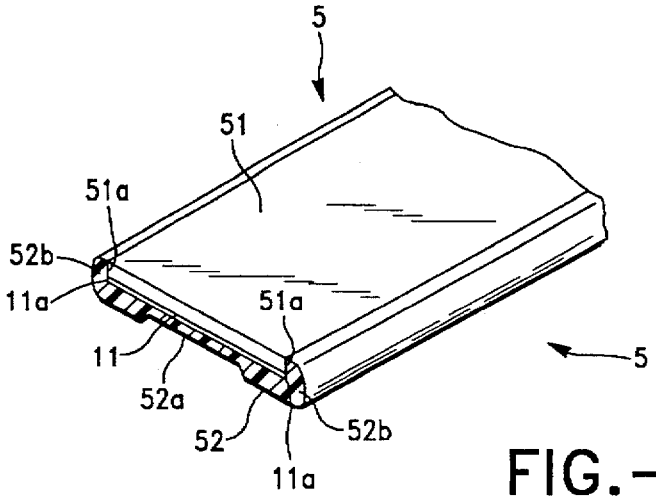
FIG. 8 illustrates the structure of the first wristband segment of the wristband of FIG. 1.
Figure 7A:
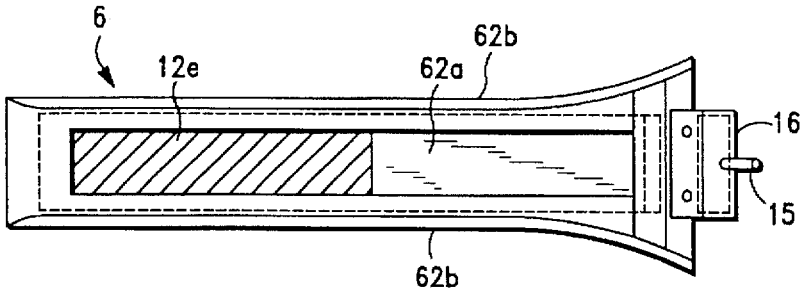
FIGS. 7A–7D show a second wristband segment of the wristband of FIG. 1.
Figure 7B:
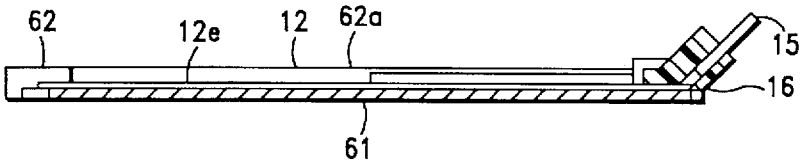
Figure 7C:
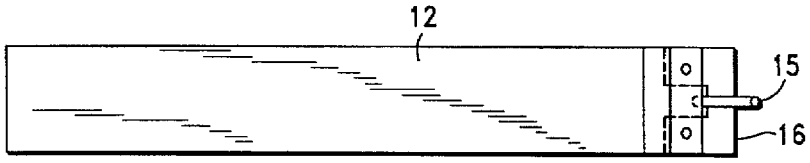
Figure 7D:
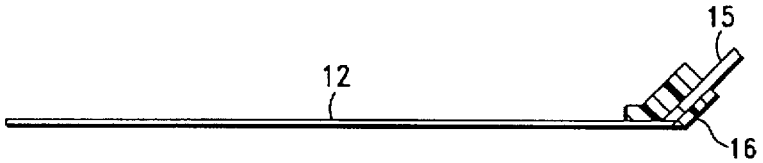

As shown in FIG. 8, at its both sides, the urethane inner layer member 52 of wristband segment 5 includes extended portions 52*b* which extend beyond both edges 11*a* of antenna strip 11 and cover both side surfaces 51*a* of the leather outer layer member 51. Thus, wristband segment 51 of the this embodiment has both sides covered by the urethane extended portions 52*b* and the fibrous surfaces of the leather outer layer member 51 are not exposed. Hence, wristband segment 51 has an excellent appearance. In addition, since antenna strip 11 is covered at its both edges 11*a* with the urethane extended portions 52*b* which has a resilient shearing strength higher than that of silicone resin, shearing is not likely to occur at the edges of antenna strip 11.

Figure 6A:
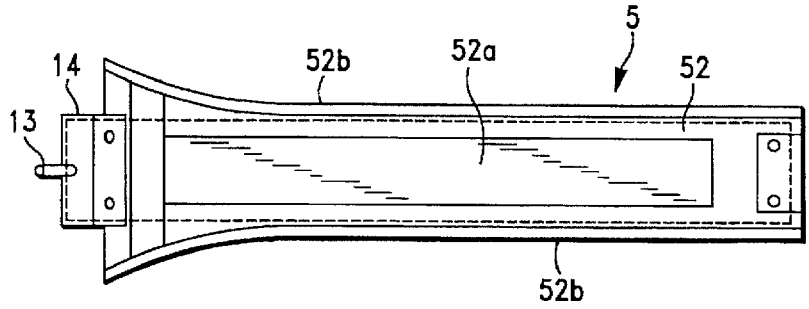
FIGS. 6A–6D show a first wristband segment of the wristband of FIG. 1.
Figure 6B:
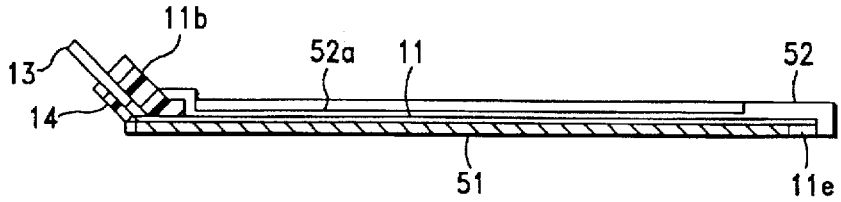
Figure 6C:
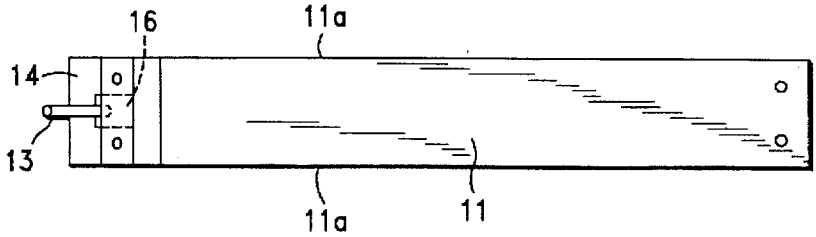
Figure 6D:
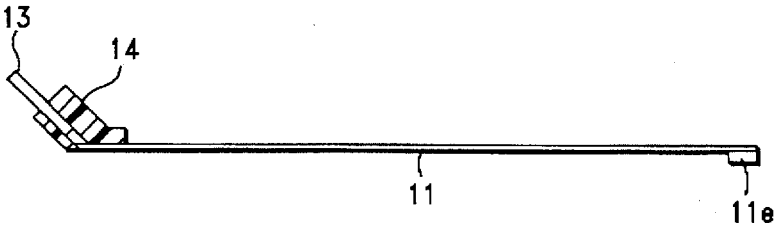
Figure 9A:
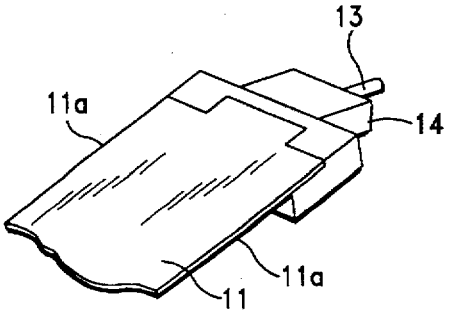
FIGS. 9A and 9B are enlarged perspective view and a sectional view respectively of a portion of the antenna strip of the wristband of FIG. 1, showing the end piece being integrally formed therewith.
Figure 9B:
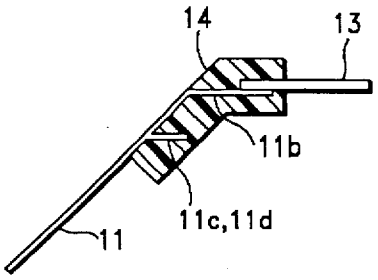
Figure 11:
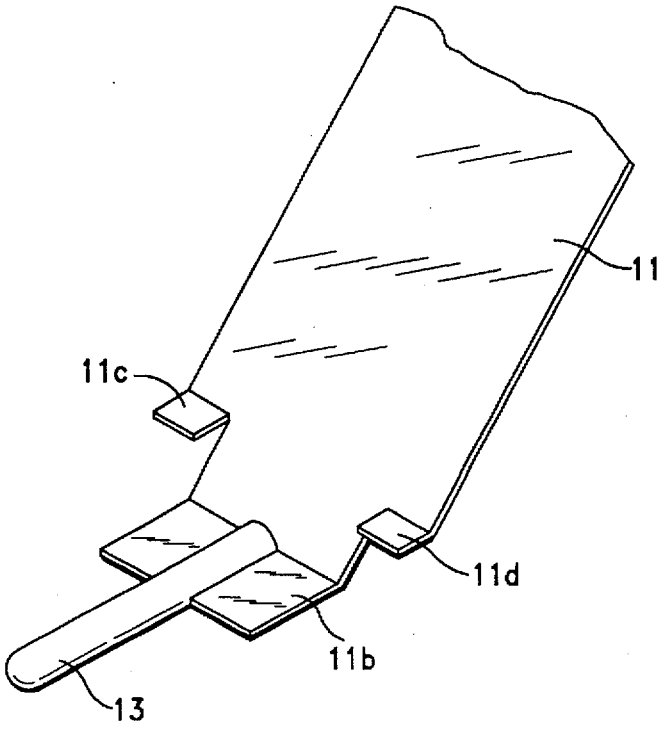
FIG. 11 is an enlarged partial perspective view of the antenna strip of FIG. 1, showing a portion where the connecting pin is connected.

Antenna strip 11 placed in wristband segment 5 has a narrow elongated rectangular shape and is made of stainless steel as shown in FIGS. 6C and 6D. Antenna strip 11 has a bent portion formed by bending a portion of its proximal end toward its rear side. FIGS. 9 and 11 illustrate the proximal end of antenna strip 11. As shown in these figures, the proximal end of antenna strip 11 is divided into three portions along the width direction. The central divided portion is bent to form bent portion 11*b*. The other divided portions located at the respective sides of bent portion 11*b* are bent at a point set back from the bent point of central bent portion 11*b* to thereby form bent portions 11*c* and 11*d*. A terminal pin 13 is welded to central bent portion 11b for electrical connection between antenna strip 11 and communicating unit 2 housed in main body 3. In this embodiment, the proximal end of terminal pin 13 is cut to have a flat surface and is welded to central bent portion 11*b*. An end piece 14 is integrally connected to the proximal end portion of antenna strip 11 so as to enclose these bent portions 11*b*, 11*c* and 11*d* as well as terminal pin 13. Antenna strip 11 also has a terminal plate 11*e*, at its distal end, for electrical connection between antenna strip and first portion 8 of metal clasp 7.

Figure 10:
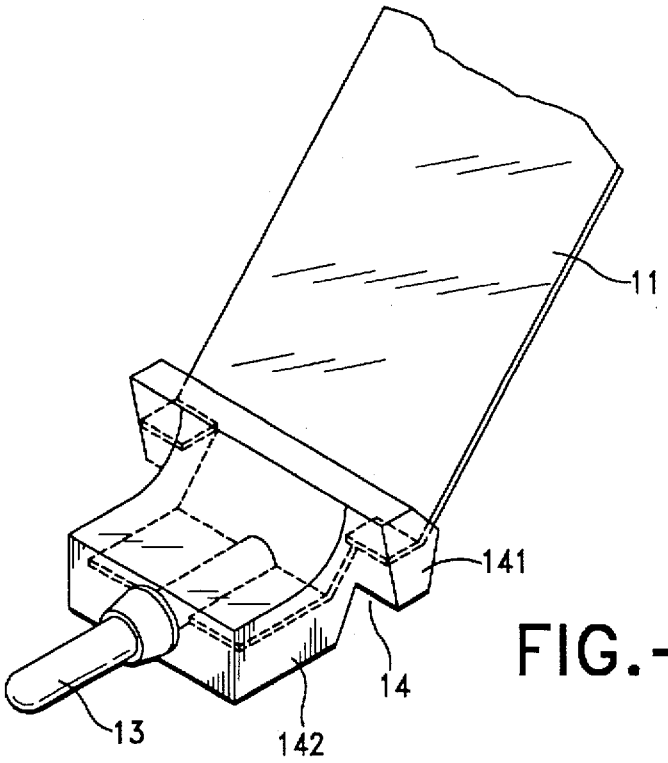
FIG. 10 is an enlarged partial perspective view of the antenna strip of FIG. 1, showing the end piece thereof.

Next, as shown in FIGS. 9 and 10, end piece 14 is made of synthetic resin having a strength higher than that of urethane. Preferably, the end piece is made of ABS resin or polycarbonate resin. End piece 14 has a root portion 141 for enclosing bent portions 11*c* and 11*d* of antenna strip 11, and a rectangular projected portion 142 for enclosing central bent portion 11*b*. Conventionally, when the metal end piece is used, there are many problems. For example, floating capacitance is inevitably added to antenna strip 11 by the metal end piece. Also, the insulating coating around the end piece tends to be thin compared with the other portion of the antenna strip, which results in the insulation around the end piece to become poor. Additionally, the manufacturing cost is rather high. Although end piece 14 can be made of urethane, an sufficient attachment strength between wristband segment 5 and main body 3 cannot always be obtained. By using the insulating molded plastic part as end piece 14, these problems can be solved.

Figure 12A:
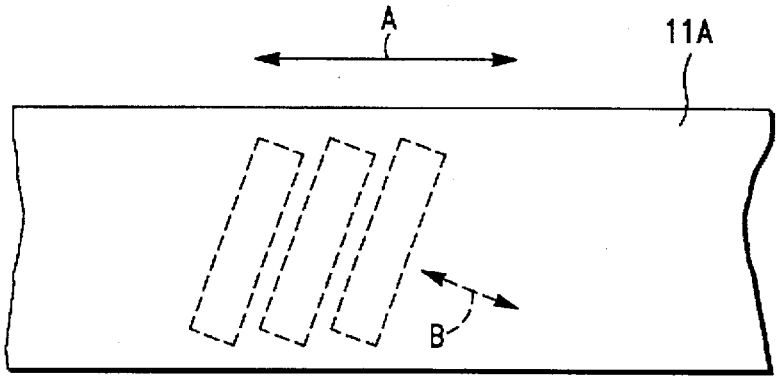
FIGS. 12A–12C illustrate respectively a rolled sheet of stainless steel from which an antenna strip is obtained.
Figure 12B:
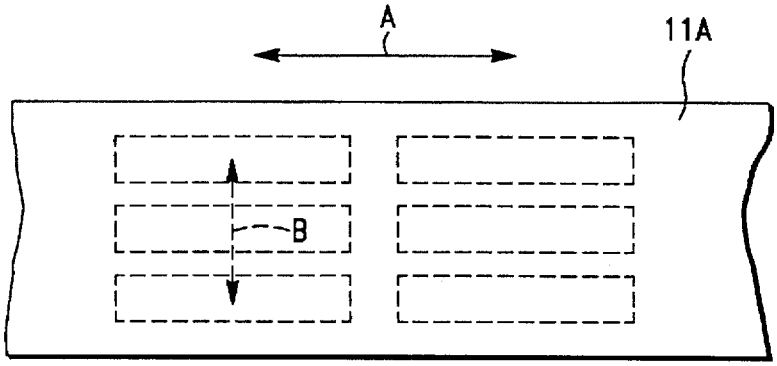
Figure 12C:
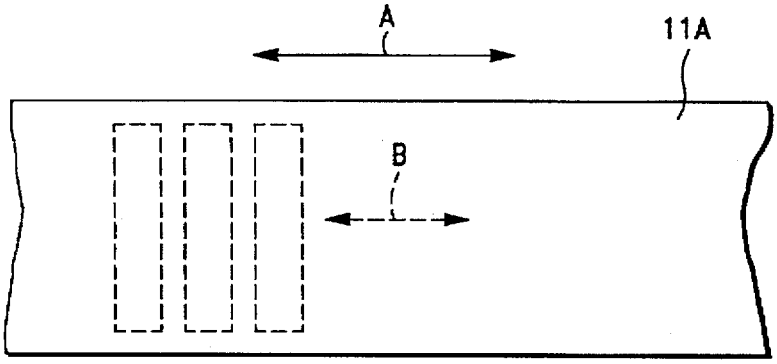
FIG.—12C (PRIOR ART)

Antenna strip 11 is obtained by cutting a rolled sheet of stainless steel as follows. As shown in FIGS. 12A and 12B, antenna strip 11 is obtained by cutting the rolled sheet of stainless steel 11A so that the rolled direction (shown by Arrow A) of rolled sheet 11A is not aligned with the band-width direction (shown by Arrow B) of the antenna strip. For example, in FIG. 12A, rolled sheet 11A is cut along a dotted line inclined relative to rolled direction A to form antenna strip 11. In FIG. 12B, rolled sheet 11A is cut along a dotted line orthogonal to rolled direction A to form antenna strip 11. Conventionally, the rolled sheet is cut along the rolled direction to form the antenna strip in consideration of the yield as shown in FIG. 12C. Thus, the resultant antenna strip has the rolled direction aligned with the band-width direction, so that it can be easily bent along the band-width direction, degrading the durability of the antenna strip during use. According to the present invention, however, the rolled direction of the resultant antenna strip 11 is not aligned with the band-width direction and therefore antenna strip 11 is not likely to be bent along the band-width direction.

Figure 13A:
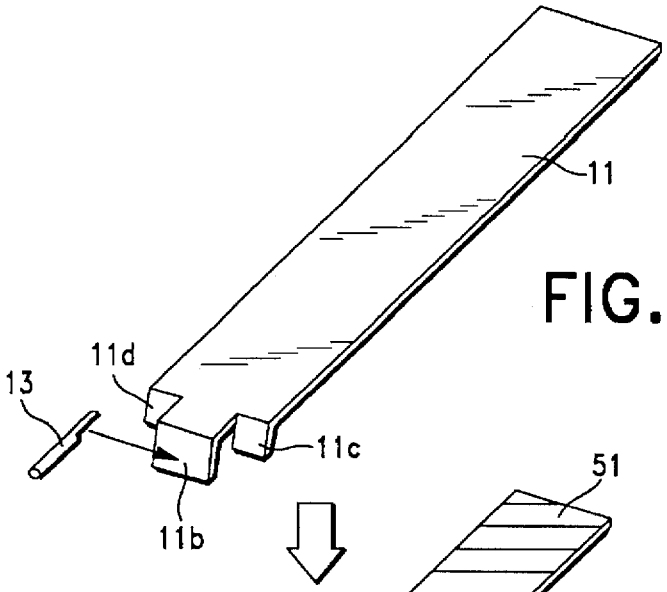
FIGS. 13A–13C illustrate a flow of manufacturing the wristband segment of the wristband of FIG. 1.
Figure 13B:
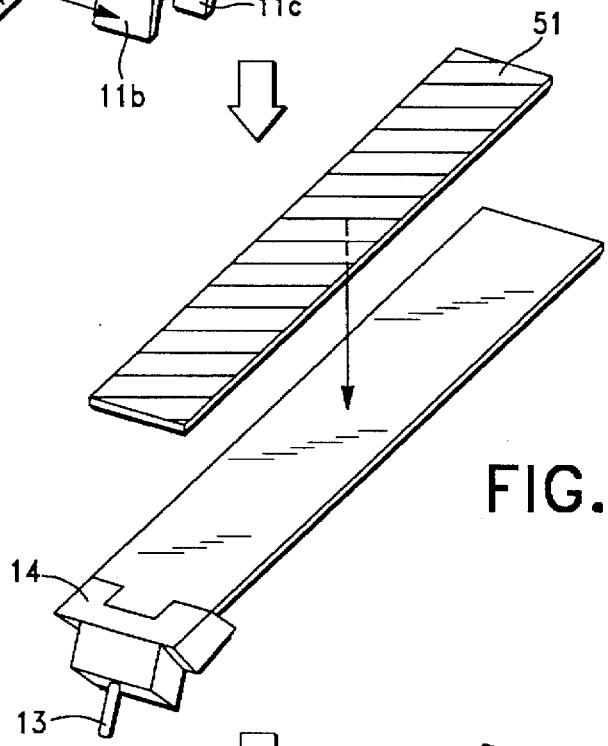
Figure 13C:
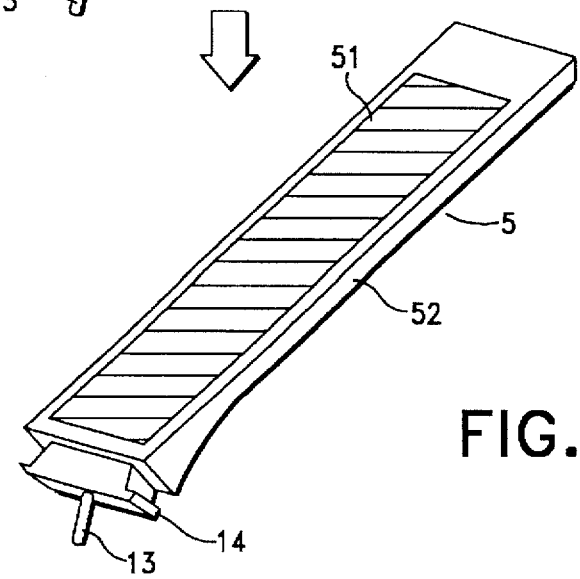

With reference to FIG. 13, an example of the manufacturing process of wristband segment 5 will be explained. First, antenna strip 11 is prepared by cutting a rolled sheet of stainless steel as mentioned above. Bent portion 11*b* is formed at one end of the antenna strip. Then, terminal pin 13 is welded to bent portion 16 as shown in FIG. 13A. Next, end piece 14 is formed integrally on the end of antenna strip 11 so as to enclose bent portion 11*b* and terminal pin 13. Outer layer member 51 made of leather is prepared and is processed to form an adhesive layer on its inner surface. Member 51 is adhered on the surface of antenna strip 11. Then, an injection molding of inner layer member 52 is carried out in a condition when the assembled outer layer member 51 and antenna strip 11 are placed in a mold, whereby wristband segment 5 is obtained as shown in FIG. 13C.

Wristband Segment 6

Now, the other wristband segment 6 will be explained. Wristband segment 6 has substantially the same structure as that of wristband segment 5 and can be manufactured using the same process as shown in FIGS. 13A to 13C. More specifically, as shown in FIG. 7, wristband segment 6 is constituted by a leather outer layer member 61, an inner layer member 62 of an urethane molded part, and an antenna strip 12 of stainless steel sandwiched between outer layer member 61 and inner layer member 62.

Inner layer member 62 includes a recess 62*a* extending longitudinally. In recess 62*a*, a thin urethane layer at the bottom covers a portion of antenna strip 12 at the proximal end side and an exposed portion 12*e* of antenna strip 12 is present at the distal end side. Second portion 9 of metal clasp 7 is mounted on wristband segment 6 in such a manner that it is slidable longitudinally in the range in which antenna exposed portion 12*e* is present. As can be seen from FIGS. 2 and 3, second portion 9 of metal clasp 7 has an antenna contact portion 9*a* at the inner side projecting toward and contacting exposed portion 12*e* of antenna strip 12. Thus the length of wristband 4 can be freely adjusted to the size of the user's wrist.

As explained above, wristband segment 6 has recess 62*a* at the inner surface, whereby a thin portion of wristband segment 6 is formed. Hence, wristband segment 6 has a sufficient flexibility even though it includes a rigid antenna strip made of stainless steel. Further, recess 62*a* is formed extending continuously along the surface of wristband segment 6, and therefore it is not sealed by the user's wrist when it is mounted. Thus, sweat or dust does not deposit on the exposed portion of antenna strip 12 to degrade the conductivity or performance of the antenna.

Wristband segment 6 of this embodiment also includes extended portions 62*b* which extend along both edges of inner layer member 62 and beyond the edges of antenna strip 12 to cover the edges of outer layer member 61.

Antenna strip 12 in wristband segment 6 has substantially the same shape as that of antenna strip 11 in wristband segment 5 except that it is not provided at its distal end with a terminal plate. In other words, antenna strip 12 has a bent portion formed by bending its proximal end, and a terminal pin 15 welded to the bent portion for connecting antenna strip 12 to communicating unit 2 housed in main body 3. Bent portion 12*b* and pin 15 are enclosed by an end piece 16 integrally formed on the proximal end of antenna strip 12. End piece 16 has the same structure as that of end piece 14 formed on antenna strip 11, as shown in FIG. 10.

Furthermore, antenna strip 12 is also obtained by cutting a rolled sheet of the stainless steel so that the rolled direction of the sheet is not aligned with the band-width direction of the resultant antenna strip 12.

Wristband 4 constituted by wristband segments 5 and 6 has the following advantages. First, since outer layer members 51, 61 of wristband 4 are made of leather, wristband 4 has an excellent appearance. Further, inner layer members 52, 62 made of urethane include extended portions 52*b* and 62*b* at their side edges for covering the fibrous surfaces of leather exposed on the lateral-side surfaces of outer layer members 51 and 61. Thus, the appearance of the wristband can be enhanced. Furthermore, since the parting line of the outer layer member and the inner layer member is not positioned along the lateral edges of the antenna strip embedded in the wristband segment, shearing or the like can be prevented from occurring along the parting line of these members.

Second, wristband 4 having inner layer members 52, 62 made of urethane has a high resilient shearing strength and an excellent wear resisting property compared to those of silicone resin utilized in making a conventional wristband. Therefore, the edges of the antenna strips 11, 12 can be prevented from cutting through wristband 4 to hurt the user's wrist. In addition, fine design patterns applied on the surfaces of wristband 4 will not be worn out by being rubbed with sleeves of the suit of the user or the like. Further, since the urethane layer of wristband 4 has recesses 52*a* and 62*a* at its inner surface to provide partial thinned portions, wristband 4 is sufficiently flexible for use as a wristband. The recesses extend continuously along the longitudinal direction of the wristband, whereby the recesses will not be sealed by the user's wrist when it is mounted, thereby preventing deposition of sweat or dust in the recesses. Thus, the electrical conductivity and feel of wristband can be well maintained.

Third, wristband segment 6 has exposed portion 12*e* of the antenna strip extending longitudinally at its inner surface on which the second portion of metal clasp 7 is slidably mounted. Therefore, the second portion of metal clasp 7 can be at a desired position along the longitudinal direction of exposed portion 12*e*, while maintaining contact with antenna strip 12. Hence, the length of wristband 4 can be precisely adjusted to the size of the user's wrist.

Fourth, antenna strips 11, 12 do not have holes formed therein as in the conventional antenna strips. The holes are used to enhance the integrity of the antenna strip with the outer layer member and the inner layer member of the wristband. Since antenna strips 11, 12 have no holes, they are not likely to be broken after a long time of use. Thus, the durability of the antenna strips can be improved. Also, since antenna strips 11, 12 are attached to the outer layer member and the inner layer member by means of adhesive or primer processing, a sufficient attachment between the antenna strip and the two members can be obtained. Further, since the antenna strips have the rolled direction not aligned with the band-width direction, the antenna strips are not likely to be broken along the band-width direction.

Fifth, the end pieces mounted on the ends of the respective antenna strips 11, 12 are made of ABS resin or polycarbonate resin having a strength higher than that of urethane. Hence, the problems resulting from using a metal end piece as in the conventional wristband can be prevented. In addition, the attachment strength between the wristband segments and the main body can be assured.

In the above embodiment, the outer layer member of the wristband is made of leather. Alternatively, synthetic leather, other natural materials can be used for the outer layer member. Likewise, the inner layer member may be made of any suitable synthetic resin other than urethane.

In addition, in the above embodiment, the inner layer member of each of the wristband segments has extended portions at both ends for covering the side-edge surfaces of the outer layer member. Alternatively, the outer layer member may have extended portions at both ends for covering the side-edge surfaces of the inner layer member. Further, the extended portions may be formed at both sides of the outer layer member and the inner layer member.

In order to provide the wristband with a sufficient flexibility, the recess on the inner layer member may be in the form of discontinuous recesses for providing the wristband with thinned portions. Although the recess is preferably a continuous one as in the above embodiment in order to prevent dust or sweat from depositing in the recess, the recess may be of any appropriate shape.

Moreover, the end pieces may be made of any appropriate synthetic resin other than ABS resin or polycarbonate resin so long as a sufficient strength can be obtained.

Connection of the Wristband to the Main Body

Now, the connecting structure of wristband 4 to main body 2 will be explained.

Figure 4:
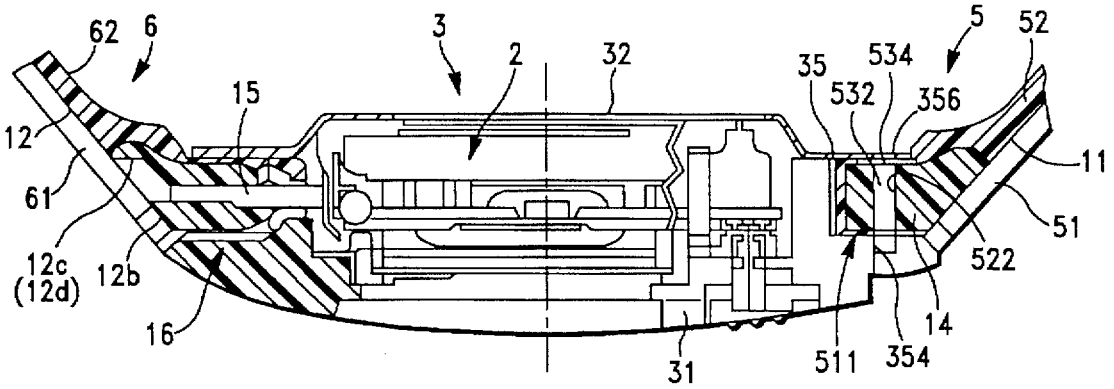
FIG. 4 is a partial sectional view taken along line IV—IV of FIG. 3.
Figure 5:
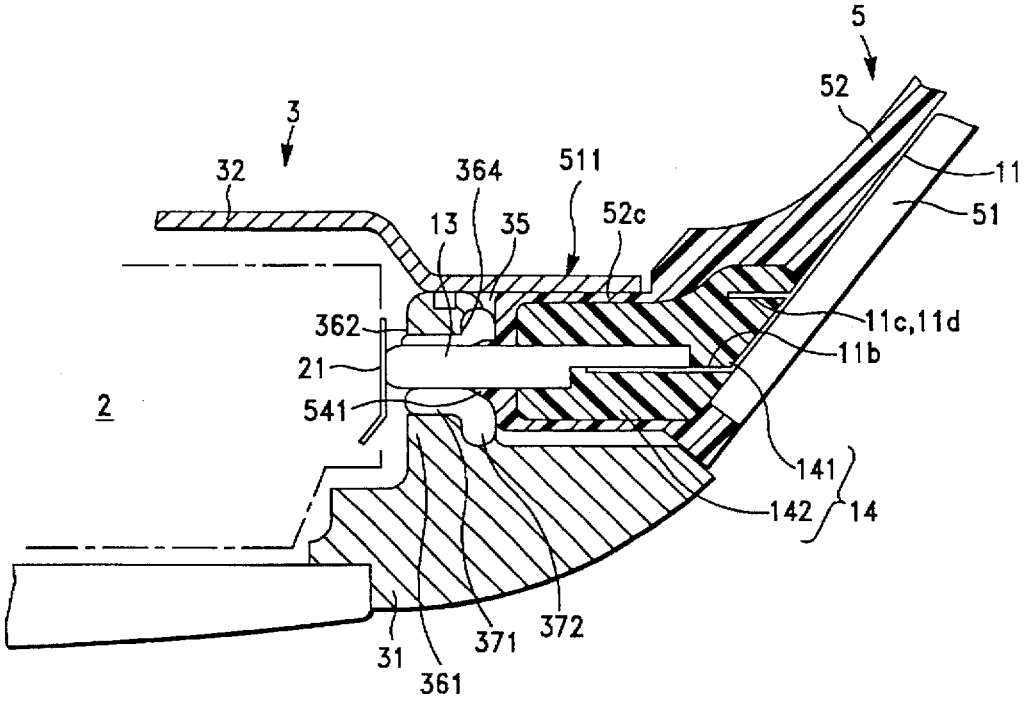
FIG. 5 is a partial sectional view taken along line V—V of FIG. 3.
Figure 14:
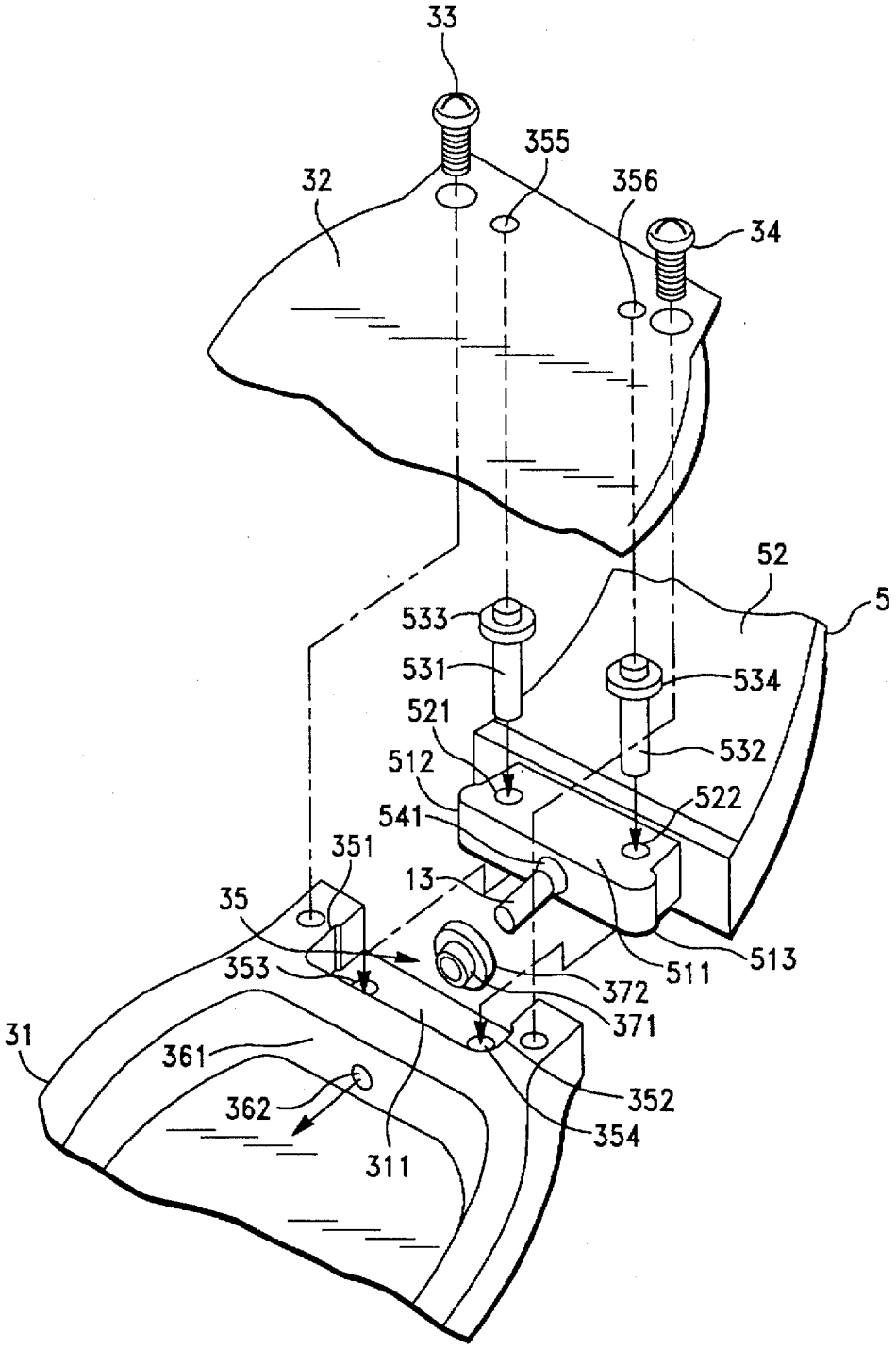
FIG. 14 is an exploded view of a portion of the wrist-mountable type electronic device of FIG. 1, showing the connecting structure of the wristband to the main body.

As can be seen from FIGS. 4, 5 and 14, first wristband segment 5 has end piece 14 at its proximal end. End piece 14 has projected portion 142 enclosed circumferentially by a covering layer 52*c* made of urethane, forming a rectangular-shaped projection 511 for connecting wristband segment 5 to main body 2. On the other hand, main body case 31 has a rectangular-shaped recess 311 at its one side. When main body case 31 is attached to case back 32 by fastening screws 33 and 34, an inserting groove 35 is formed between recess 311 of the main body case and case back 32 for receiving projection 511 of wristband segment 5.

Projection 511 of wristband segment 5 has engaging projections 512 and 513 formed at its both sides. These engaging projections 512, 513 are formed of covering layer 52*c* of urethane and are shaped so that they are gradually extended laterally from the tip side to the proximal side of projection 511. Inserting groove 35 of main body 2 has an opening slightly narrower in width than projection 511. The two sides of groove 35 are gradually set back laterally from the opening side to the rear side of the groove. Thus, groove 35 has step portions 351 and 352 formed at its lateral side surfaces capable of engaging with engaging portions 512 and 513 of projection 511.

When projection 511 is inserted into inserting groove 35, since engaging projections 512 and 513 are made of resiliently deformable urethane, these projections are forced to resiliently deform and therefore can be inserted into groove 35 completely. When projection 511 is fully inserted into groove 35, engaging projections 512 and 513 are in engagement with step portions 351 and 352, respectively. Thus, wristband segment 5 is temporarily fixed to main body 2 and is prevented from being removed.

Engaging projections 512, 513 and step portions 351, 352 may be formed in any other suitable shapes so long as the temporary engagement condition can be achieved as in the present invention.

As shown FIGS. 4, 5 and 14, projected portion 511 of wristband segment 5 includes a pair of pin-inserting holes 521 and 522 extending along the thickness direction. On the sides of main body case 31 and case back 32 facing these holes 521 and 522, there are pin-fitting holes 353, 354 and 355, 356, respectively. Connecting pins 531 and 532 are inserted through pin-inserting holes 521 and 522 in a manner that the upper and lower ends of the respective pins are fitted into the corresponding pin-fitting holes 353,355 and 354, 356. In addition, the end portions of pins 531 and 532 projecting toward case back 32 include disc-shaped flanges 533 and 534 for preventing the pins from dropping out of the holes.

In this embodiment, connecting pins 531 and 532 are inserted into pin-inserting holes 521 and 522 of projected portion 511 of wristband segment 5, respectively. Thereafter, projected portion 511 is inserted into inserting groove 35 of the main body. As a result, projected portion 511 is in the temporary engagement condition as mentioned above. Then, case back 32 is placed on main body case 31, and both ends of pins 531 and 532 are fitted into the corresponding pin-fitting holes 353, 355 and 354, 356. In this condition, screws 33 and 34 are fastened to fix case back cover 32 to main body case 31, whereby flanges 533 and 534 are sandwiched between case back 32 and projected portion 511 and are prevented from dropping out of the holes. Hence, wristband segment 5 is fixedly connected to main body 2.

As mentioned before, terminal pin 13 is projected from projected portion 511 of wristband segment 5. Terminal pin 13 is inserted into pin through-hole 362 on a side wall 361 defining the rear surface of inserting groove 35. The projected end of terminal pin 13 inserted into main body 2 is forced to contact with a contacting plate spring member 21 of the electronic circuitry housed in main body 2.

In this embodiment, a tubular bushing 371 is used to electrically insulate terminal pin 13 from pin through-hole 362 of main body case 31. Tubular bushing 37 1 is made of insulating resilient material. For example, the bushing is a molded part of urethane. Bushing 371 is formed integrally with a flange 372 of a large diameter. An opening portion of pin through-hole 362 facing the wristband segment includes an annular groove 364 for receiving flange 372 of bushing 371. Bushing 371 is arranged in pin through-hole 362 into which pin 13 is inserted. Thus, pin 13 is electrically insulated from pin through-hole 362 on the main body case by the body portion of the bushing 371. Flange 372 of bushing 371 is made thicker than the depth of annular groove 364. Thus, when projected portion 511 is fully inserted into inserting groove 35, flange 372 is compressed by the end surface of projected portion 511 by a certain amount. On the other hand, the portion of terminal pin 13 near projected portion 511 is surrounded by a tapered portion 541 formed by covering layer 52*c* of urethane. Therefore, when terminal pin 13 is inserted into bushing 371, flange 372 of bushing 371 is compressed by the end surface of projected portion 511, and at the same time the opening portion of flange 372 is expanded radially and outwardly by tapered portion 541. As mentioned above, flange 372 is compressed by a certain amount in the thickness direction. By means of terminal pin 13, flange 372 of bushing 371 is forced to push against pin through-hole 362. Therefore, a waterproof structure around the pin through-hole can be obtained.

In addition, since tapered portion 541 around pin 13 acts as a guide member when pin 13 is inserted into the hole, the insertion of projected portion 511 of wristband segment 5 into main body 2 can be carried out easily.

Moreover, according to this embodiment, projected portion 511 of wristband segment 5 is enclosed by covering layer 52*c* of flexible urethane, and tapered portion 541 formed around pin 13 is also formed of covering layer 52*c*. Therefore, even if manufacturing errors or mounting errors of projected portion 511 and/or pin 13 exist, covering layer 52c is resiliently deformable, whereby projected portion 511 can be inserted into and fixed to inserting groove 35 in a tightly fitted condition.

The other wristband segment 6 is connected to main body 2 in the same manner as described above in connection with wristband segment 5, and therefore, the explanation is omitted.

Figure 15:
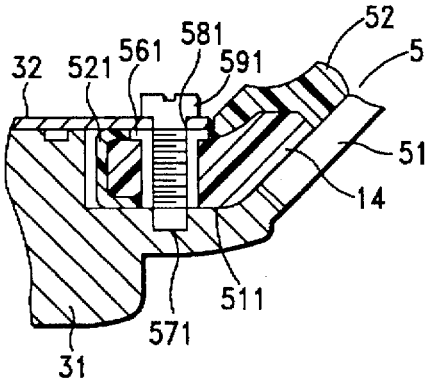
FIG. 15 is a partial sectional view of the present invention, showing a different connecting structure of the wristband to the main body.
Figure 16:
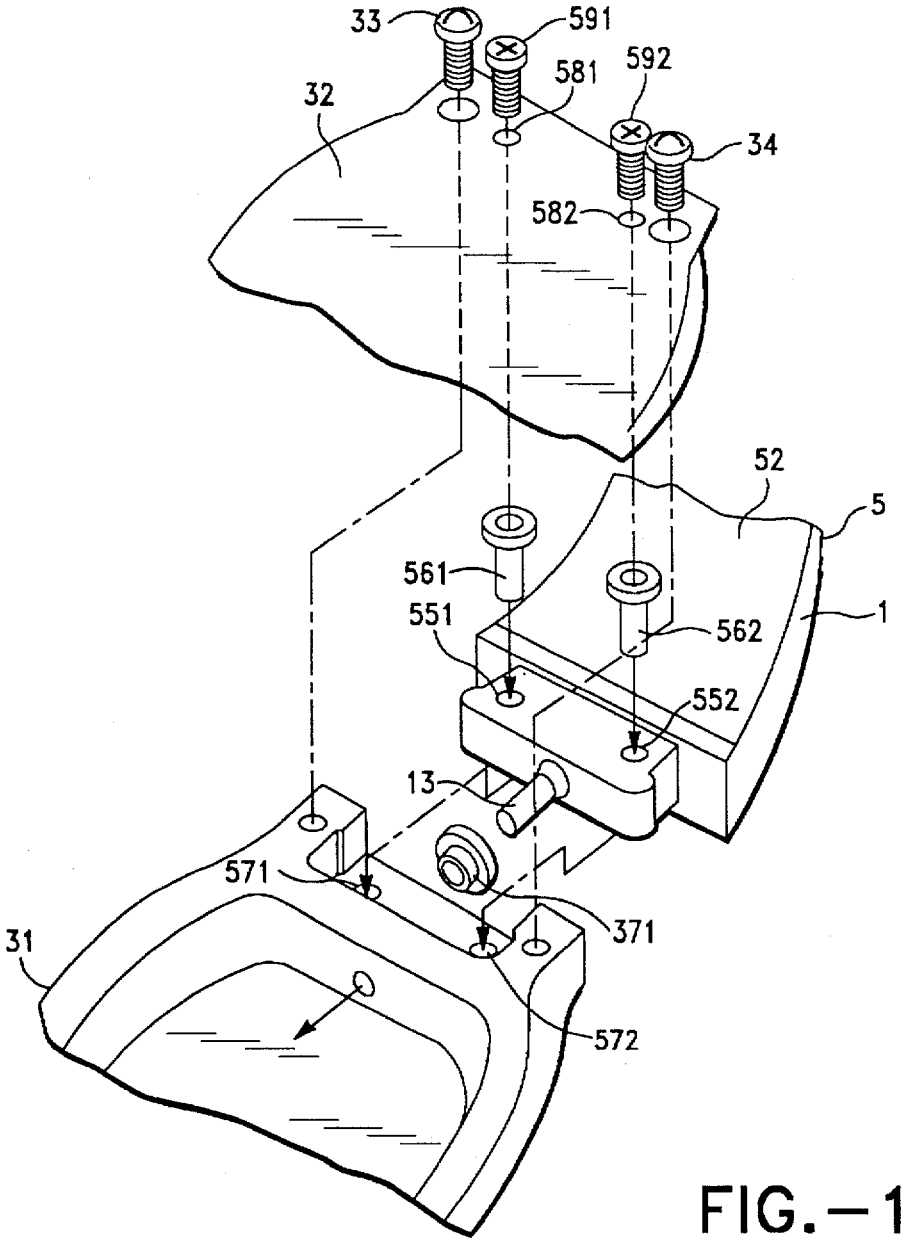
FIG. 16 is an exploded view of a portion of the connecting structure in FIG. 15.

FIGS. 15 and 16 show another embodiment of the connecting structure of the wristband segment to the main body. In this embodiment, projected portion 511 of wristband segment 5 includes a pair of bushing fitting holes 551 and 552 in the thickness direction. In these holes 551,552, metal tubular bushings 561 and 562 are inserted. These bushings are formed with screw holes. The portions of main body case 31 and case back cover 32 facing holes 551 and 552 include screw holes 571, 581 and 572, 582, respectively. The other constitution of the embodiment is the same as that of the above embodiment. Therefore, the corresponding portions are denoted by the same reference numerals and the explanation is omitted.

In the present embodiment, after or before main body case 31 is fixed to case back 32 by the screws, wristband segment 5 is temporarily fixed to main body 2 by inserting projected portion 511 into inserting groove 35. Then, the fixing screw 591 is fastened through hole 581, bushing 561 and hole 571. Likewise, screw 592 is fastened through hole 582, bushing 562 and hole 572. As a result, wristband segment 5 is fixedly connected to main body 2.

According to this structure, wristband segment 5 can be removed from main body 2 by removing only screws 591 and 592 without separating case back 32 from main body case 31. Therefore, the wristband segments can be easily and rapidly replaced.

In the above embodiments, the invention is used in the wrist watch-type wireless set having an antenna of the loop type in the wristband. The present invention can be similarly used in other types of wrist-mountable type wireless sets. For example, the invention can be used in a wrist-mountable type wireless set having an antenna of the slot type.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A wristband for a wrist-mountable type electronic device, comprising;

first and second wristband segments each for coupling to one side of the electronic device, each of said wristband segments comprising:

an electrically insulating inner layer member for contact with a wrist of a wearer;

an electrically insulating outer layer member made of a material different from that of said inner layer member; and an antenna strip, made of an electrically conductive member and sandwiched between said inner layer member and said outer layer member, for electrically coupling to the electronic device;

wherein in at least one of said two wristband segments, at least one of said inner and outer layer members includes extended portions on two opposite sides along the lengthwise direction, said extended portions extending beyond adjacent edges of said antenna strip and covering at least a portion of adjacent edges of the other layer member.

2. The wristband of claim 1 wherein said inner layer member is made of urethane.

3. The wristband of claim 2 wherein said outer layer member is made of ornamental material.

4. The wristband of claim 2 wherein said outer layer member is made of leather.

5. The wristband of claim 1 wherein in at least one of said wristband segments, said antenna strip is attached to at least one of said inner and outer layer members by means of primer processing.

6. The wristband of claim 1 wherein said layer member that includes said extended portions is formed by injection molding.

7. The wristband of claim 1 wherein said antenna strips are made from a rolled sheet of material, with the rolled direction of the sheet being different from the band-width direction of said antenna strips.

8. The wristband of claim 1 further comprising a metal clasp attached to at least one of said first and second wristband segments, and wherein said antenna strips form a loop antenna of the electronic device when connected by said metal clasp.

9. A wristband for a wrist-mountable type electronic device, comprising:

first and second wristband segments each for coupling to one side of the electronic device, each of said wristband segments comprising:

an electrically insulating inner layer member for contact with a wrist of a wearer;

an electrically insulating outer layer member made of a material different from that of said inner layer member; and an antenna strip, made of an electrically conductive member and sandwiched between said inner layer member and said outer layer member, for electrically coupling to the electronic device;

wherein said inner layer member of said second wristband segment includes a recess extending continuously along the longitudinal direction and facing the wrist of the wearer when the electronic device is mounted on the wrist.

10. The wristband of claim 9 wherein said inner layer member is made of urethane.

11. The wristband of claim 10 wherein said outer layer member is made of ornamental material.

12. The wristband of claim 10 wherein in at least one of said two wristband segments, at least one of said inner and outer layer members includes extended portions on two opposite sides along the lengthwise direction, said extended portions extending beyond adjacent edges of said antenna strip and covering at least a portion of adjacent edges of the other layer member.

13. The wristband of claim 10 wherein said second wristband segment further includes a thin layer within the recess covering a portion of the antenna strip.

14. The wristband of claim 10 wherein each wristband segment includes an end piece, integrally formed with one end of said antenna strip, for connecting the respective wristband segment to the electronic device, and wherein said end piece is made of an insulating synthetic resin having a strength higher than that of urethane.

15. The wristband of claim 10 further comprising a metal clasp including a first portion attached to said first wristband segment and a second portion slidably attached to and in contact with a portion of said antenna strip exposed by the recess.

16. A wristband for a wrist-mountable type electronic device, comprising:

first and second wristband segments each for coupling to one side of the electronic device, each of said wristband segments comprising:

an electrically insulating inner layer member made of urethane for contact with a wrist of a wearer;

an electrically insulating outer layer member made of ornamental material; and an antenna strip, attached between said inner layer member and said outer layer member, for electrically coupling to the electronic device, said antenna strip being made from a rolled sheet of electrically conductive material such that the rolled direction of the sheet is not aligned with the band-width direction of said antenna strip;

wherein in at least one of said two wristband segments, at least one of said inner and outer layer members includes extended portions on two opposite sides along the lengthwise direction, said extended portions extending beyond adjacent edges of said antenna strip and covering at least a portion of adjacent edges of the other layer member;

wherein said inner layer member of said second wristband segment includes a recess extending continuously along the longitudinal direction and facing the wrist of the wearer when the electronic device is mounted on the wrist.

17. The wristband of claim 16 wherein each wristband segment includes an end piece, integrally formed with one end of said antenna strip, for connecting the respective wristband segment to the electronic device, and wherein said end piece is made of an insulating synthetic resin having a strength higher than that of urethane.

18. The wristband of claim 16 further comprising a metal clasp including a first portion attached to said first wristband segment and a second portion slidably attached to and in contact with a portion of said antenna strip exposed by the recess, and wherein said antenna strips form a loop antenna of the electronic device when connected by said metal clasp.

19. A wrist-mountable type electronic device, comprising:

a main body housing electronic circuits and including a pin through-hole; and a wristband coupled to said main body, said wristband including:

first and second wristband segments each coupled to one side of the main body, each of said wristband segments comprising:

an electrically insulating inner layer member for contact with a wrist of a wearer;

an electrically insulating outer layer member made of a material different from that of said inner layer member;

an antenna strip made of an electrically conductive member and sandwiched between said inner layer member and said outer layer member; and a connecting pin attached to one end portion of said antenna strip and inserted into the pin through-hole of said main body so as to electrically connect said antenna strip to said electronic circuits; and an end piece integrally enclosing said connecting pin and the end portion of said antenna strip, said end piece being made of an insulating material having a high mechanical strength than that of said inner layer member.

20. The device of claim 19 wherein in each wristband segment the end portion of said antenna strip includes bent portions.

21. The device of claim 19 wherein in each wristband segment at least a portion of said end piece is covered with a covering layer made of the same material as that of said inner layer member to form a projected portion of said wristband.

22. The device of claim 21 wherein said main body includes two grooves and each projected portion of said wristband is inserted into a respective groove of said main body; and wherein each projected portion and each groove include engaging projections extended outwardly from their two sides for engagement with each other when the projected portion is inserted into the respective groove.

23. The device of claim 22, further comprising a fixing pin having a flange;

wherein said projected portion includes at least one pin through-hole extending along the thickness direction of said main body and said main body includes pin-fitting holes; and wherein said flange of said fixing pin is inserted into said pin through-hole of said projected portion such that both ends of said fixing pin are fitted into said pin-fitting holes of said main body and that said flange of said fixing pin is sandwiched between said projected portion and said main body along the thickness direction of said main body.

24. The device of claim 22, further comprising a screw, wherein said projected portion includes at least one screw through-hole extending along the thickness direction of said main body and said main body includes screw holes and wherein said screw is fastened through said screw through-hole and said screw holes.

25. The device of claim 22, wherein at least one of said wristband segments further comprises a tubular elastic member made of insulating material and disposed between said pin through-hole of said main body and said connecting pin, wherein said tubular elastic member includes a flange facing said wristband segment and having an outer diameter larger than the inner diameter of said pin through-hole.

26. The device of claim 25 wherein said flange of said tubular elastic member has a predetermined thickness in the inserting direction of said projected portion of said wristband so that when said projected portion is inserted into said groove, said flange is compressed by said projected portion by a certain amount along the inserting direction.

27. The device of claim 26 wherein said connecting pin includes a root portion comprising a circumferentially tapered outer portion capable of expanding said tubular elastic member in its radial direction when said connecting pin is inserted into said tubular elastic member.

* * * * *